United States Patent [19]

Bobier

[11] 3,991,658

[45] Nov. 16, 1976

[54] FLUID DEVICE HAVING SINTERED METAL COMPONENTS

[76] Inventor: Wilfred S. Bobier, 4518 Brightmore, Bloomfield Hills, Mich. 48013

[22] Filed: July 11, 1974

[21] Appl. No.: 487,771

Related U.S. Application Data

[63] Continuation of Ser. No. 264,540, June 20, 1972, abandoned, which is a continuation-in-part of Ser. No. 60,333, Aug. 3, 1970, Pat. No. 3,739,591.

[52] U.S. Cl. ..... 91/505

[51] Int. Cl.[2] ..... F01B 13/04

[58] Field of Search..... 308/DIG. 5; 417/252; 91/504, 506, 499; 29/205

[56] References Cited

UNITED STATES PATENTS

| | | | |
|---|---|---|---|
| 2,709,339 | 5/1955 | Edelmann et al. | 417/252 |
| 2,786,726 | 3/1957 | Tarr | 308/DIG. 5 |
| 2,975,720 | 3/1961 | Schoellhammer | 91/487 |
| 2,994,600 | 8/1961 | Hanson | 75/205 |
| 3,060,690 | 10/1962 | Horlacher | 91/506 |
| 3,124,008 | 3/1964 | Firth et al. | 91/506 |
| 3,262,762 | 7/1966 | Bechtold | 75/205 |
| 3,389,990 | 6/1968 | Gullett | 75/205 |
| 3,631,764 | 1/1972 | Lucien | 91/506 |

*Primary Examiner*—William L. Freeh
*Attorney, Agent, or Firm*—Basile and Weintraub

[57] ABSTRACT

A fluid device of the axial piston type having high and low pressure operating passages, one of which may be an inlet and the other an outlet depending upon the pumping or motoring function of the device. The fluid device which may be of the fixed or variable displacement type has a rotatable cylinder barrel with each end of a plurality of pistons disposed for reciprocation within cylinder bores in the cylinder barrel, and cylinder ports successively communicating each of the cylinder bores with arcuate inlet and outlet passages formed in a valve face disposed at one end of the cylinder barrel. The other ends of the pistons are drivingly engaged by an inclined thrust plate assembly disposed to impart a reciprocal stroking movement to the pistons within the cylinder bores as the cylinder barrel is rotated. In one example of the invention, the thrust plate assembly is constructed from a pressed sintered material having a predetermined density, the surface of which is hardened by a nitriding or other suitable process.

7 Claims, 5 Drawing Figures

FLUID DEVICE HAVING SINTERED METAL COMPONENTS

CROSS-REFERENCE TO RELATED PATENT APPLICATIONS

This application is a continuation application of Ser. No. 264,540 filed June 20, 1972, now abandoned, which in turn is a continuation-in-part application of application Ser. No. 60,333, filed Aug. 3, 1970 in the name of Wilfred Bobier and now U.S. Pat. No. 3,739,591.

BACKGROUND OF THE INVENTION

I. Field of the Invention

The present invention relates to fluid devices and, particularly, to those of the axial piston type which may function either as a fluid pump or as a fluid motor.

II. Descritpion of the Prior Art

Heretofore, fluid pumping or motoring devices of the axial piston type have been constructed of a metallic housing having a revolving cylinder barrel with a plurality of parallel cylinder bores therein, within which pistons are reciprocated by means of a thrust plate assembly or the like. A rotary valve mechanism in the form of cylinder ports at one end of the cylinder barrel alternately connects each cylinder bore with an inlet and an outlet passage of the device as the cylinder barrel is rotated.

The thrust plate assembly in fluid devices of the variable displacement type normally takes the form of a yoke having transversely extending pintles rotatably carried in bearings suitably mounted to the wall of the housing such that the entire force exerted against the thrust plate assembly due to the fluid pressure acting against the piston within the cylinder barrel bores is taken by the housing, thus necessitating a strong metal housing. Such metal housings are expensive in that they must be cast molded and subsequently require a machining operation to provide the necessary precision that is needed in such constructions.

Further, heretofore fluid devices of the variable displacement type have used a thrust plate assembly which is normally of a metal construction such as cast iron or steel which, in addition to requiring substantial machining, adds to the overall weight of the device. It would be desirable to replace such cast iron and/or steel thrust plate assemblies with one constructed of a sintered material which, heretofore, has not been possible because of the high loads and complicated shape that such thrust plate assemblies require.

As speed and pressure, are increased in such previously used fluid devices, there is always an accompanying increase in noise. This general increase in noise with increased speed and pressure may be attributed to a number of factors in devices of the axial piston type. First, the second frequencies generated by the device increase with speed as the components of the device are subjected to increased alternating impact forces; second, the intensity of speed related sounds increases as the impact forces between components of the device increase; and third, the excitation spectrum of the significant piston harmonics also broadens, thus increasing the number of resonant responses.

It would therefore be desirable to provide a fluid device wherein the attendant noise and vibration levels are significantly reduced.

SUMMARY OF THE INVENTION

The present invention, which will be described subsequently in greater detail, comprises a fluid pumping or motoring device of the axial piston type having a substantially large percentage of the rotating parts thereof constructed of a sintered material, providing an axial piston fluid device adapted for use over a wide range of applications.

It is therefore an object of the present invention to provide a rotary fluid device of the axial piston type having an improved construction which is readily adapted to low cost manufacturing.

It is also an object of the present invention to provide a rotary fluid device of the axial piston type having an improved thrust plate assembly resulting in greater reliability and longer life while operating at high pressures and temperatures, proportioned and simplified so that it can be made inexpensively from sintered materials.

It is also an object of the present invention to provide a rotary fluid device of the axial piston type having a construction which contributes to the reduction in the general noise radiated by such a device.

Other objects, advantages, and applications of the present invention will become apparent to those skilled in the art of such fluid devices when the accompanying description of one example of the present invention is read in conjunction with the accompanying drawings.

BRIEF DESCRIPTION OF THE DRAWINGS

The description herein makes reference to the accompanying drawings wherein like reference numerals refer to like parts throughout the several views, and in which.

DESCRIPTION OF THE PREFERRED EMBODIMENT

Figure 2:
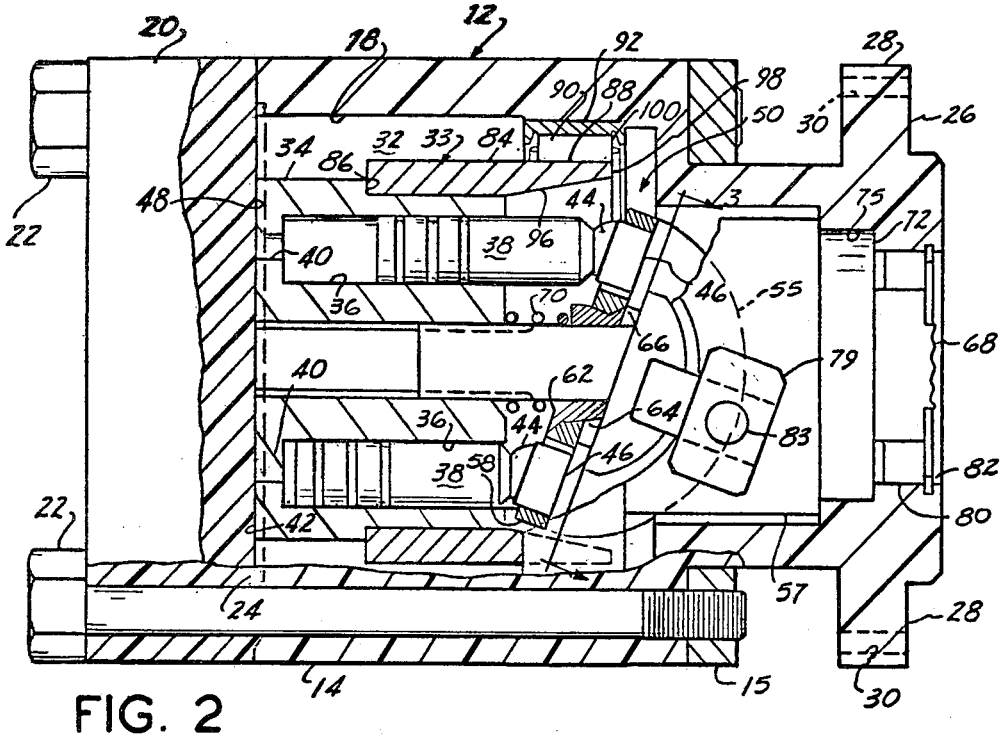
FIG. 2 is a longitudinal cross section view of the fluid device taken on line 2—2 of FIG. 1.
Figure 1:
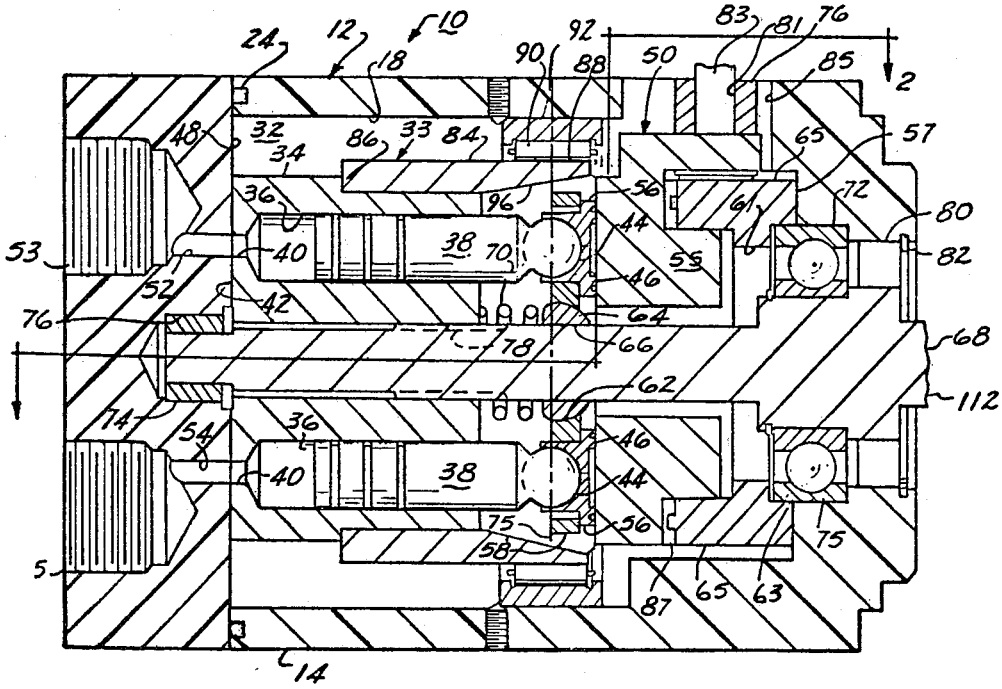
FIG. 1 is a longitudinal cross sectional view of a fluid device incorporating the principles of the present invention.
Figure 5:
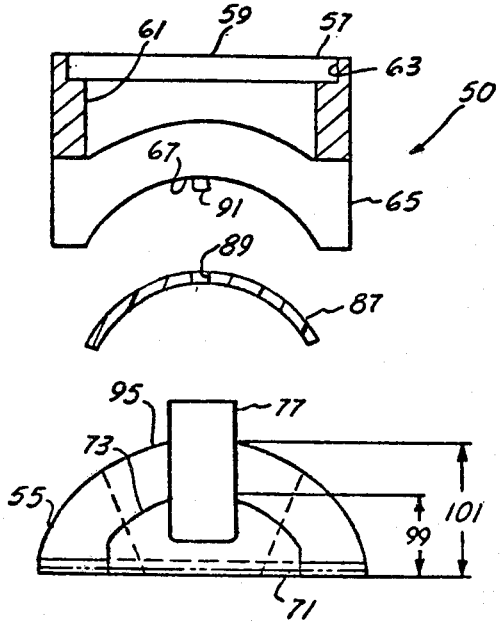
FIG. 5 is a fragmentary, exploded view of the fluid device illustrated in FIG. 1.

Referring to the drawings, and particularly FIGS. 1 and 2, there is illustrated a fluid device in the form of an axial piston pump 10 comprising a plastic housing 12 having a body section 14 constructed of a plastic material and a longitudinally disposed bore 18 enclosed by a cap 20 secured to the body section 14 by bolts 22 extending axially through the cap 20 and the body section 14 and threadedly engaging clamps 15. An O-ring 24 insures a fluid tight seal between the juncture of the body section 14 and the cap 20. The body section 14 includes a pilot portion 26 forming a mounting flange 28 having mounting holes 30 extending therethrough to permit the mounting of the pump 10 at a desired location. The housing bore 18 provides a chamber 32 in which a rotating group 33 is positioned. The rotating group 33 includes a cylinder barrel 34 which is provided with a plurality of arcuately spaced cylinder bores 36, each having one end of a piston 38 axially slidable therein. A plurality of cylinder ports 40 axially aligned with each cylinder bore 36 communicate each of the cylinder bores 36 with a front face 42 of the cylinder barrel 34. Each of the pistons 38 have spherical ends 44 on which are swaged socketed shoes 46. The cylinder barrel 34 is positioned axially between a valving face 48 formed on the inner face of the cap 20 and inclined thrust plate assembly 50. The valving face 48 serves in a well known manner to provide a properly phased connection between the cylinder ports 40 and a pair of arcuate ports 52 and 54 such that the cylinder ports 40 communicate successively with the arcuate ports 52 and 54 as the cylinder 34 barrel rotates. The arcuate ports 52 and 54 are, respectively connected to the external inlet and outlet connection ports 53 and 55 of the pump 10.

The piston shoes 46 have outwardly extending flanges 56 (FIG. 1) which are contacted by an annular cage 58 with holes corresponding to each piston 38. The annular cage 58 has a centrally disposed conical bore 62 adapted to contact a spherical outer surface 64 of a collar 66 which is, in turn, carried on a drive shaft 68 that extends longitudinally through the housing bore 18. A spring 70 disposed between the piston end of the cylinder barrel 34 and the collar 66 exerts a force urging the face 42 of the cylinder barrel 34 into engagement with the valving face 48, while at the same time biases the shoes 46 by means of the collar 66 and the annular cage 58 into engagement with the thrust plate assembly 50.

The drive shaft 68 is supported between bearings 72 and 74. The bearing 72 is carried in a bore 75 of a decreased diameter at the thrust plate assembly end of the housing 12 while the bearing 74 (FIG. 1) is carried in a centrally disposed bore 76 within the cap 20. the drive shaft 68 is effective to transmit torque from a prime mover (not shown) to the cylinder barrel 34 through a splined driving connection 78 in a convention manner. A conventional shaft seal 80 is provided in the decreased diameter bore 75 and retained in position by a snap ring 82.

The cylinder barrel 34 is provided with a skirt portion 84 snuggly fitted in a recessed portion 86 at the piston end of the cylinder barrel 34 to form an inner race 88 for roller bearings 90; the outer race 92 of which is carried by the body section 14 in abutment with the thrust plate assembly in a manner describd hereinafter. The skirted portion 84 has an annular inclined inner surface 96 extending upwardly from the cylinder barrel 34 and terminating in such a manner that the thrust plate assembly end 98 of the inner race 88 is flush with the thrust plate assembly end 100 of the roller bearings 90. Heretofore, fluid devices have been constructed with the inner race of a bearing extending beyond the roller bearings the same distance as the outer race. By having the end 98 of the inner race 88 flush with the end 100 of the roller bearings 90, a greater diameter of thrust plate assembly 50 with respect to the longitudinal axis is provided which may increase the displacement capacity of the pump 10 by as much as 15% as compared to fluid devices heretofore constructed by allowing the pistons to operate on a larger piston bore circle. The piston bore circle is a circle defined by the longitudinal axes of the pistons 38 as the same rotate about the longitudinal axis of the shaft 68. As the diameter of the piston bore circle is increased, the diameter of each piston bore 36 may likewise be increased, thus the displacement of the pump 10 may be increased without increasing the overall size thereof.

The cylinder ports 40 are arranged in a circle, having a radius equal to the radius of the arcuate ports 52 and 54 so that communication will be maintained throughout the full length of the arcuate ports 52 and 54. This communication will be interrupted whenever a cylinder port 40 moves across a cutoff portion or space (not shown) separating the arcuate ports 52 and 54.

As the cylinder barrel 34 rotates, a reciprocating stroking motion is imparted to the pistons 38 due to the inclination of the thrust plate assembly 50, and thus a relative reciprocating motion between the cylinder barrel 34 and the pistons 38 results as the cylinder barrel 34 rotates wherein the cylinder bores 36 are alternately compressed and expanded, resulting in fluid being drawn into and expelled from the cylinder bores 36 through the cylinder ports 40.

From the foregoing it can be seen that when a rotary movement is imparted to the outer end 112 of the drive shaft 68, the cylinder barrel 34 will be revolved to alternately register the cylinder bores 36 with the arcuate ports 52 and 54 in the valving face 48 by means of the cylinder ports 40.

Referring to FIGS. 1–5 for an understanding of the accompanying description of the thrust plate assembly 50 which comprises a movable yoke 55 and a fixed yoke support 57. The fixed yoke support 57 has a U-shaped configuration, the bottom wall 59 of which has a bore 61 through which the drive shaft 68 extends. The bore 61 has an end enlarged portion 63 having an inner diameter closely fitting the outer diameter of the drive shaft support bearing 72, and thus, as can best be seen in FIG. 1, the yoke support 57 is axially aligned with respect to the drive shaft 68 when positioned on the outer periphery of the bearing 72.

The yoke support 57 includes a pair of axially projecting sidewalls 65, each of which has arcuately shaped bearing surface 67 supporting the movable yoke 55 on which the piston shoes 46 slidably engage as the cylinder barrel 34 is rotated so as to impart a reciprocal stroking movement to the pistons 38. The yoke 55 has a pair of transversely extending aligned support pins 69 and 71 each of which has arcuately shaped bearing surfaces 67 of the projecting sidewalls 65 such that the yoke 55 is adapted to pivot within the side wall bearing surfaces 67 about an axis 75 (FIG. 1) defined by the radius of the transversely extending support pins 69 and 71.

The yoke support pin 71 includes an L-shaped arm 77 integrally formed therewith and projecting rearwardly away from the support pin 71. The projecting leg of the arm 77 slidably carries a member 79 having a slot 81 in which a connecting pin 83 is disposed. The connecting pin 83 extends through an opening 85 formed in a sidewall of the body section 14 and is adapted to be coupled to any suitable displacement varying mechanisms such as the mechanisms disclosed in the aforementioned U.S. patent application. The opening 85 is so sized as to permit the member 79 to be positioned therethrough onto the arm 77 during assembly with the connecting pin 83 extending through the housing body section 14 and adapted to pivot about the axis 75 defined by the radius of the support pins 69 and 71 without interference with the sidewall of the housing bore 85. As can best be seen in FIG. 2, the preferred axis of rotation for the connecting pin 83 and, for the purposes of description of the longitudinal axis of the support pins 69 and 71, is the axis 75 passing through the center point about which each of the arcuate bearing surfaces 73 is formed. The axis 75 should intersect the plane at which the centers of the spherical piston ends 44 lie and may also intersect the longitudinal axis of the drive shaft 68. However, the axis 75 may be vertically offset from the drive shaft axis, in a well known manner, depending upon the desired results.

The arcuately shaped bearing surfaces 67 formed on the sidewalls of the yoke support 57 are in the form of a plastic bearing 87, such as a Teflon-lead bearing or the like, which provides the necessary support to withstand the load transmitted through the pistons 38 and the movable yoke 55, while at the same time offering the least amount of frictional resistance to the pivotal movement of the yoke 55 therewithin. The plastic bearings 87 each have a central aperture 89 (FIG. 5) adapted to receive a boss 91 formed in each sidewall 65 to securely retain the bearing 87 on its associated sidewall 65.

The yoke 55 has a circular thrust bearing face 93 with which the shoes 46 cooperate and a hemispherical cross section 95 (FIG. 5) with an elliptical, centrally disposed bore 97 through which the drive shaft 68 extends. The elliptical shape of the bore 97 permits the yoke 55 to rotate about the axis 75 without interference with the shaft 68. Since the yoke 55 and the yoke support 57 are both constructed of a sintered material, the radial thickness 99 (FIG. 5 of support pins 69 and 71, as measured from the bearing face 93 to the bottom of the support pin bearing surface 73, should be at least 40% of the total thickness or longitudinal length 101 of the yoke 55 as measured from the bearing face 93 to the bottom thereof to assure that the yoke 55 will withstand the loads to which it is subjected, while the L-shaped arm 77 extending from the support pin 71 should have a length which is at least equal to the yoke thickness 101 in order to provide good fill characteristics when the same is manufactured.

The amount of friction between the bearing surfaces of the yoke 55 and the yoke support 57 will be directly proportional to the load exerted thereon, while the frictional torque is in direct proportion to the radius of the arcuate bearing surfaces 67 or 73. In the present design the radius of the bearing surfaces is kept to a minumum, and thus the frictional torque minimized. It should also be noted that present construction of the yoke 55 and the yoke support 57 results in the length 103 and the thickness 101 of the yoke 55 being respectively shorter and greater than comparable components of presently used devices. The shorter length and increased thickness of the yoke 55 reduces unit vibrations and results in an extremely quiet pump compared to such presently used designs.

Figure 3:
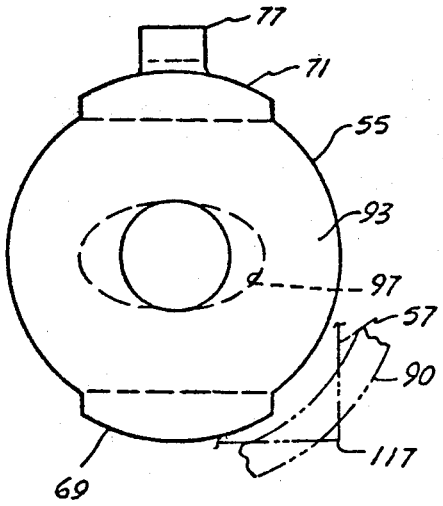
FIG. 3 is a fragmentary transverse cross sectional view of the fluid device of FIG. 1 and illustrating a component thereof and taken generally on line 3—3 of FIG. 2.
Figure 4:
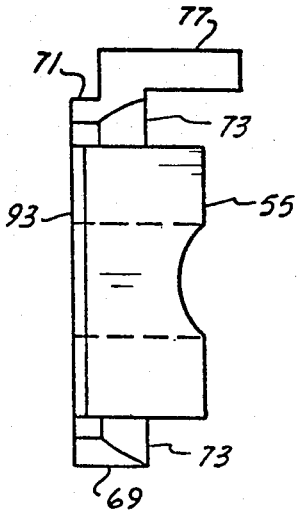
FIG. 4 is a side elevational view of the component illustrated in FIG. 3.

Since the periphery of the yoke support 57 is rectangular and the periphery of the yoke 55 is circular, each corner 117 of the yoke support 57 will project radially outwardly beyond the yoke 55 as illustrated in FIG. 3 in phantom lines. As can best be seen in FIG. 2, the bearing 90 is axially positioned with respect to the center of each piston ball 44 by the abutment of the thrust plate facing side 94 of outer race 92 against the corners 117 of the yoke support 57. This arrangement provides a simple construction which insures proper axial alignment, which is essential for a smooth, efficient and accurate operation of the pump 10.

The yoke 55 is fabricated from a sintered material, and in the preferred embodiment the yoke 55 is formed from a pure sintered iron powder having 4percent copper mixed therein which is pressed into the desired shape, heat treated and surfaced-hardened in a manner to be described. The copper content may vary from between 3 and 6 percent, however, a 4 percent volume mixture of copper is preferred. The powder mixture is then pressed to the desired yoke shape having a density between 6.2 and 6.8 grams per cubic centimeter which results in a predetermined porosity of the yoke 55 to permit a predetermined amount of penetration from the outer surface during the hardening process to be described. After pressing, the yoke 55 is sintered, that is, it is heated at a tmeperature which is close to the melting temperature of the iron where diffusion takes place so that the particles of iron and copper fuse to form a single solid mass. After the sintering operation the yoke 55 is treated to produce a hardened surface and, particularly, on the bearing surfaces 73 and 93, so that the same may be polished to an extremely smooth finish. The hardening of the yoke 55 may be accomplished through any suitable process such as carburizing, nitriding and cyaniding. The preferred method of hardening the yoke 55 is a salt bath, low temperature nitriding process; however, gas and carbo nitriding processes may also be employed. The nitriding of the yoke 55 and thus, the degree of hardness achieved on the outer surface of the yoke 55 depends upon the amount of penetration during the nitriding process of the yoke 55 which, in turn, depends on the density of the pressed powder materials. If the density is too low, the porosity of the yoke 55 will be high and penetration from the surface during the nitriding process will be deep resulting in a very brittle material and a weak yoke 55 which will fail when subjected to high pressure operation during the normal operating life of the pump. If the density is higher than desired amount, penetration during the nitriding process is not very deep which results in hard bearing surfaces 73 and 93, but which is removed during the aforementioned smooth finishing operation of the bearing surfaces 73 and 93, all of which would defeat the purpose of hardening the bearing surfaces 73 and 93. As aforementioned, the preferred density is between 6.8 g/cc which results in sufficient porosity to permit a surface penetration between 0.003 and 0.005 inches during the nitriding process. This hardens the outer bearing surfaces 73 and 93 to a sufficient degree to permit subsequent polishing without removing the hardened surface while at the same time penetration is limited so that the resulting yoke is not too hard or too weak. Thus, the aforementioned density range permits sufficient penetration of the yoke support 55 to result in a hardened outer bearing surface which is strong enough to withstand the loads imposed upon the sintered metal yoke 55 while at the same time the hardened surface is such as to permit a secondary operation to achieve this smooth finish of the surfaces 73 and 93.

Similarly, the cylinder barrel 34 is fabricated from a sintered metal and preferably from a pure sintered iron powder having a 4 per cent copper mixed therein. The powder mixture is pressed to a density between 6.2 and 6.8 grams per cubic centimeter to achieve a predetermined porosity for the hardening of the valving face 48 by means of any of the aforementioned processes and for the same reasons aforementioned.

While the form of the embodiment of the invention as disclosed herewithin constitutes a preferred form, it is to be understood that other forms may be adopted all coming within the spirity of the invention and the scope of the appended claims.

What is claimed is as follows:

1. A fluid pressure energy translating device of the axial piston type comprising:

a housing;

a cylinder barrel rotatably mounted within said housing;

said cylinder barrel having a plurality of arcuately spaced cylinder bores communicating with both longitudinal ends of said cylinder barrel;

a plurality of pistons with inner ends disposed for reciprocal stroking movements within said cylinder bores;

a valve face having passage means, said valve face and one end of said cylinder barrel being disposed for relative rotary movement with said cylinder bores communicating successively with said passage means in said valve face; and an inclined thrust plate means constructed of a sintered metal material mounted in said housing, said thrust plate having a piston engaging surface drivingly engaging the other ends of said pistons for imparting a reciprocal stroking movement to said pistons within said cylinder barrel as said cylinder barrel rotates, said piston engaging surface of said thrust plate is hardened to a predetermined depth, said inclined thrust plate means is formed from a powdered iron and copper mixture pressed to a density between 6.2 and 6.8 grams per cubic centimeter.

2. The fluid pressure energy translating device defined in claim 1, wherein said piston engaging surface of said thrust plate means is hardened by a nitriding process wherein said piston engaging surface has a compound zone to a depth between 0.003 and 0.005 inches.

3. A fluid pressure energy translating device of the axial piston type comprising:

a housing having a bore at one end, a shaft bearing fitted in said bore and extending inwardly of said housing, a shaft extending through said bore and rotatably supported in said shaft bearing, a cylinder barrel mounted on said shaft with a splined driving connection therebetween and said cylinder barrel rotatably supported at one end in a radial bearing in said housing, said cylinder barrel having a plurality of arcuately spaced cylinder bores each having a piston therein extending from said one end, a valve in abutment with the other end of said cylinder barrel and having arcuate passages alternately communicating with said cylinder bores as said cylinder barrel rotates, said device characterized in further comprising:

a pivoted yoke and a support member therefore each having central openings through which said shaft extends, said support member at the opening therein being mounted on the inwardly extending portion of said shaft bearing and having a pair of transversely spaced arcuately shaped bearing surfaces, said yoke constructed of sintered metal material and having a thrust face in engagement with said pistons for imparting reciprocal movement to said pistons as said cylinder barrel rotates, said thrust face is hardened to a predetermined depth, said yoke having laterally extending bearing pins with arcuately shaped bearing surfaces engaging the arcuately shaped bearing surfaces of said support member, each of said bearing pins having a radial thickness substantially less than the radial thickness of the portion of said yoke intermediate said bearing pins, and a lever arm integral with an end of one of said bearing pins, said yoke is formed from a powdered iron and copper mixture pressed to a density between 6.2 and 6.8 grams per cubic centimeter, and means for coupling to said lever arm to pivot said yoke in said support member for varying the inclination of the thrust face thereof.

4. The fluid pressure energy translating device defined in claim 3 wherein said thrust face is hardened by a nitriding process.

5. The fluid pressure energy translating device defined in claim 3, wherein said piston engaging surface of said thrust plate means is hardened by a nitriding process wherein said piston engaging surface has a compound zone to a depth of between 0.003 and 0.005 inches.

6. An article of manufacture comprising a yoke constructed from a sintered metal material, said yoke having on one side thereof, a flat bearing surface disposed in a plane that is transverse to the longitudinal axis of said yoke, said yoke having a pair of integrally formed support pins extending laterally outwardly from said flat bearing surface, said support pins having arcuately shaped bearing surfaces adapted to be pivotally supported by similarly shaped bearing surfaces on a support member; means for pivoting said yoke in said last mentioned arcuately shaped bearing surfaces, said flat bearing surface being hardened by a nitriding process wherein said flat bearing surface has a compound zone to a depth between 0.003 and 0.005 inches, said cylinder barrel is formed from a powdered iron and copper mixture pressed to a density between 6.2 grams per cubic centimeter.

7. The article of manufacture defined in claim 6 further comprising an arm member extending rearwardly away from said flat bearing surface of said yoke and disposed at one end on one of said support pins, said arm member being laterally spaced from said support pin bearing surfaces and adapted to be engaged by a means for arcuately displacing said arm member and thus pivoting said yoke within said support member bearing surfaces.

* * * * *

UNITED STATES PATENT AND TRADEMARK OFFICE

CERTIFICATE OF CORRECTION

PATENT NO. : 3,991,658

DATED : November 16, 1976

INVENTOR(S) : Wilfred S. Bobier

It is certified that error appears in the above–identified patent and that said Letters Patent are hereby corrected as shown below:

Column 5, line 29, After "5" insert--)--;

Column 6, line 13, preceding "which" delete "tmeperature" and insert --temperature--;

Column 8, line 48, after "6.2" insert --and 6.8--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*